US007637317B1

(12) United States Patent
Hernandez et al.

(10) Patent No.: US 7,637,317 B1
(45) Date of Patent: Dec. 29, 2009

(54) FRAC GATE AND WELL COMPLETION METHODS

(76) Inventors: Alfred Lara Hernandez, 432 San Saba, Portland, TX (US) 78374; Dudley Iles Klatt, P.O. Box 1007, Orange Grove, TX (US) 78372

( * ) Notice: Subject to any disclaimer, the term of this patent is extended or adjusted under 35 U.S.C. 154(b) by 196 days.

(21) Appl. No.: 11/973,049

(22) Filed: Oct. 5, 2007

Related U.S. Application Data

(60) Provisional application No. 60/849,918, filed on Oct. 6, 2006.

(51) Int. Cl.
*E21B 43/26* (2006.01)
*E21B 34/14* (2006.01)

(52) U.S. Cl. ..... 166/177.5; 166/373; 166/308.1; 166/387

(58) Field of Classification Search ..... 166/177.5, 166/373, 313, 308.1, 285, 386
See application file for complete search history.

(56) References Cited

U.S. PATENT DOCUMENTS

| | | | | |
|---|---|---|---|---|
| 3,856,085 | A | 12/1974 | Holden et al. | |
| 4,949,788 | A * | 8/1990 | Szarka et al. | 166/285 |
| 5,156,207 | A | 10/1992 | Haugen et al. | |
| 5,183,114 | A | 2/1993 | Mashaw, Jr. et al. | |
| 6,394,184 | B2 | 5/2002 | Tolman et al. | |
| 6,543,538 | B2 | 4/2003 | Tolman et al. | |
| 6,782,952 | B2 | 8/2004 | Garay et al. | |
| 2006/0124310 | A1 | 6/2006 | Cardenas et al. | |
| 2006/0124311 | A1 * | 6/2006 | Lopez de Cardenas et al. | 166/313 |
| 2006/0124315 | A1 | 6/2006 | Frazier et al. | |
| 2006/0207763 | A1 * | 9/2006 | Hofman | 166/281 |

OTHER PUBLICATIONS

Sep. 25, 2006, Halliburton website information re Bar Pressure Vent.
Sep. 13, 2006, Baker Oil Tools India website information re Model "B-NEL" Sliding Sleeve.
2006, TechTool International technical information re Model "TXA" Sliding Sleeve (Otis Type).
May 15, 2006, Society of Petroleum Engineers Paper (SPE 100572) by Rytlewski and Cook (Schlumberger).
May 19, 1999, Society of Petroleum Engineers Paper (SPE 55618) by Constantine (Baker Oil Tools).
Jul. 2003, Baker Hughes Incorporated—Coiled Tubing Solutions handbook excerpt.

* cited by examiner

*Primary Examiner*—Kenneth Thompson
(74) *Attorney, Agent, or Firm*—George S. Gray

(57) ABSTRACT

Methods and apparatus are provided for oil and gas well completions without conventional perforations or jet cutting. One or more frac gate tool(s) are included in the production casing string or liner which is cemented in the hole. The frac gates have a sleeve that is openable by a shifting tool to allow fluids inside the casing or liner to exit through ports and breakdown and treat the adjacent formation. Casing flapper valves are placeable above a lower frac gate to isolate the treated formation from a higher producing zone during treatment of the higher zone through a higher frac gate. A single hydraulically actuated shifting tool is usable to open the frac gates and close the casing flapper valves.

24 Claims, 13 Drawing Sheets

FRAC GATE AND WELL COMPLETION METHODS

CROSS-REFERENCE TO RELATED APPLICATION

This application claims priority from U.S. Provisional Patent Application Ser. No. 60/849,918 filed Oct. 6, 2006, by the inventors herein, Alfred Lara Hernandez and Dudley Iles Klatt.

BACKGROUND OF THE INVENTION

1. Field of the Invention

The field of the invention is subterranean well completions, or, more specifically, methods and apparatus for independently completing target completion intervals in a cased wellbore without conventional perforations.

2. Description of Related Art

In the oil and gas industry, many wells have more than one subterranean interval targeted for completion. In particular, wellbores frequently have a horizontal portion deviated from a generally vertical well into a large, productive formation. The horizontal portion extends deep into the formation, in a direction generally perpendicular to the vertical wellbore. It is typical for the operator to have predetermined which intervals along the horizontal wellbore are likely to provide the optimum production of the formation. In such a case, the operator desires that the intervals be initially accessed and treated in isolation from other intervals. To this end, it is currently the most common practice to run casing through the horizontal wellbore, cement the casing in place, perforate the casing proximate the first and lowest desired interval, treat the perforated interval (such as with a frac job using frac sand or ceramic spheres as proppants), isolate the interval using bridge plugs or sand plugs, then perforate and treat and isolate the next interval, repeating until all desired intervals have been perforated and treated. This practice requires that a time-consuming trip out of the hole and back in be made with all the tools between each interval.

Another practice includes utilizing a cutting/washing tool to cut two holes in the casing proximate the desired completion interval using special sand-water mixture jetted against the casing from the tool, washing out the sand from the wellbore, then pulling the cutting/washing tool into the vertical casing, treating the newly exposed formation interval through the two holes, and then isolating the newly treated interval by placing a sand plug at and above the two holes. Among the problems with this approach is the inability to determine the precise location and size of the two holes, which are typically small, with a combined area of far less than the cross-sectional area of the casing bore. This large difference in areas has a "choke" effect on the total fluid flow, such that the full casing bore capacity is underutilized. An additional problem is the special cutting sand, of which a notable amount remains in the wellbore in the vicinity of the two holes, even after washing. It is believed that this special cutting sand is carried into the formation by the initial fluids used in the following treatment (frac fluids), and often completely plugs formations near the holes, thus "screening out" the injection and preventing the completion of the frac job. This plugging effect is different from the usually benign practice of spotting normal frac sand in the casing to a point above the two holes—such sand being efficiently washed from the holes without a post-completion plugging effect. Typically, this practice has proven to be unnecessarily time-consuming and will typically result in one interval completion per day, occasionally going as high as three intervals completed per day.

Attempts have also been made to use flapper valves to isolate the interval below while perforating and treating the interval above. These attempts have been only partially successful, largely due to the nature of mechanical shifting tools, which open once and stay open, and the mechanical shifting tools failing to properly close the flapper valves, as well as, sand interference in the flapper mechanism itself, or sand interference between the shifting tool and the flapper valve profile that interacts with the shifting tool. Attempts include wells where conventional perforation were used, as well as, wells where the perforations were cut as holes, in the manner described above. When the perforations are cut as holes, the sand used for cutting holes is known to exacerbate this problem.

In still another practice, sliding sleeve tools have been included on the casing proximate each of the desired intervals, with the sliding sleeve intended to move to a position that opens slots to allow formation interval fluids to enter through the sliding sleeve. In this practice, the sliding sleeve was re-closed with a second shifting tool, in order to isolate the newly treated interval from the next highest interval, prior to opening the sliding sleeve for the next highest interval. The sliding sleeve tool was of the type having sleeve holes alignable with surface holes after rotation of the sleeve. Although this method has been successfully applied in completions in relatively shallow wells, where frac jobs are conducted at relatively low pressures and proppant concentrations (e.g. 1-2 ppg), this practice has not been successful in deeper wells, where frac jobs are conducted at much higher pressures and proppant concentrations (e.g. 6-7 ppg). The increased concentrations of proppant cut the sleeve in the sliding sleeve tool causing an inability to re-close the opened tool that is in the lowest completion interval, and an inability to open the sliding sleeve tools in the higher completion intervals.

What is needed is a downhole tool for use in lieu of conventional perforations and perforation cutting, particularly in deep wells where treatment will involve frac jobs with high proppant concentrations, is reliably positionable and openable when run as part of a casing string and placed proximate the desired completion intervals in a horizontal wellbore. Also needed is a reliable and cooperative means for isolating the treated intervals, while opening and treating higher intervals.

SUMMARY OF THE INVENTION

Our invention provides a tool, and methods of use, for use in lieu of conventional perforations and perforation cutting in deep wells, having multiple targeted completion intervals, where treatment of each completion interval will involve frac jobs with high proppant concentrations. The tool is constructed to maintain component integrity for multiple frac jobs without losing its opening and closing functionality. The tool can be reliably positioned and opened when run as part of a casing string and placed proximate the desired target completion intervals in a horizontal wellbore. Our invention methods provide reliable and cooperative techniques for isolating the treated completion intervals before opening and treating the higher intervals.

In some exemplary embodiments of the present invention, we have provided a casing valve for use in a well in combination with a shifting tool and a casing string, the well having a wellbore, the wellbore having a target completion interval, the casing valve being positioned in and attached to the casing string between casing members, the casing valve being placed proximate the target completion interval, the wellbore forming an annulus about at least part of the casing valve, the annulus being filled with cement, the cement substantially blocking the casing valve from the wellbore, the valve comprising: a body having a plurality of ports, each port having an area; a shifting member within the body having a solid exterior surface and an interior profile for engagement by the shifting tool such that movement of the shifting tool moves the shifting member between a first position adjacent the ports, such that the ports are closed, and a second position non-adjacent the ports, such that the ports are open, the shifting member having a bore, the bore having a cross-sectional area, the combined areas of the ports being not less than 80 percent of the bore cross-sectional area; and a plurality of resilient sealing members, at least one sealing member being positioned above and at least one below the ports when the sleeve is in the first position.

In some exemplary embodiments of the present invention, the plurality of ports comprises a port matrix, the matrix having at least three port rows, the port rows being substantially aligned with the body, the port rows being spaced substantially equally about the body, each port row having at least two ports.

In some exemplary embodiments of the present invention, we have provided a casing valve for use in a well in combination with a shifting tool and a casing string, the well having a wellbore, the wellbore having a target completion interval, the casing valve being positioned in and attached to the casing string between casing members, the casing valve being placed proximate the target completion interval, the wellbore forming an annulus about at least part of the casing valve, the annulus being filled with cement, the cement substantially blocking the casing valve from the wellbore, the valve comprising: a body having a port matrix, the matrix having at least three port rows substantially aligned with the body and spaced substantially equally about the body, each port row having at least two ports; a shifting member within the body having a solid exterior surface and an interior profile for engagement by the shifting tool such that movement of the shifting tool moves the shifting member between a first position adjacent the ports, such that the ports are closed, and a second position non-adjacent the ports, such that the ports are open; a plurality of resilient sealing members, at least one sealing member being positioned above and at least one below the ports when the sleeve is in the first position; and a locking member for preventing the sleeve from returning to the first position from the opened position.

In some exemplary embodiments of the present invention, the casing valve has a maximum exterior diameter, the attached casing members have a maximum exterior diameter, and the wellbore has a wall, the casing valve maximum exterior diameter being greater than the attached casing member maximum exterior diameters, such that the casing valve displaces at least part of the attached casing members from the wellbore wall.

In some exemplary embodiments of the present invention, the casing valve has a maximum exterior diameter and the wellbore has a wall and a diameter, the casing valve maximum exterior diameter being no less than 85 percent of the wellbore diameter, such that the casing valve displaces at least part of the attached casing members from the wellbore wall. In some exemplary embodiments of the present invention, the casing valve maximum exterior diameter is approximately 88 percent of the wellbore diameter. In some exemplary embodiments of the present invention, the casing valve maximum exterior diameter is approximately 92 percent of the wellbore diameter.

In some exemplary embodiments of the present invention, the casing in the casing string has a minimum cross-sectional interior area, and the shifting member has a minimum cross-sectional interior area at least as large as the casing minimum cross-sectional interior area.

In some exemplary embodiments of the present invention, the body has a plurality of threaded holes and the shifting member has a groove, the casing valve further comprising a plurality of shearable screws sized to threadably penetrate the body and terminate in the groove, whereby the shifting member is prevented from moving to from the first to the second position until the shifting tool engages the shifting member profile and a sufficient force is applied to shear the screws.

In some exemplary embodiments of the present invention, the body has a plurality of channels spaced between the port rows and along a portion of the body to a point above the uppermost port, cement being channeled at the time the casing and casing valve are cemented in the wellbore.

In some exemplary embodiments of the present invention, the shifting member has circumferential grooves for positioning the first at least one sealing member, the second at least one sealing member, and the locking member.

In some exemplary embodiments of the present invention, the shifting member has an upper end, the upper end having an upward-facing bevel.

In some exemplary embodiments of the present invention, the number of sealing members below the port matrix is two and the number of sealing members above the port matrix is two.

In some exemplary embodiments of the present invention, the casing valve is constructed from materials having a burst and collapse resistance greater than each of the burst and collapse resistance of the casing members.

In some exemplary embodiments of the present invention, the shifting member is constructed from nitrided material.

In some exemplary embodiments of the present invention, at least some of the ports are substantially filled with a filling material prior to attachment to the casing, the filling material being removed by fluids flowing from within the apparatus.

In some exemplary embodiments of the present invention, at least some of the ports are substantially covered by a coating prior to attachment to the casing, the coating being penetrated by fluids flowing from within the apparatus.

In some exemplary embodiments of the present invention, we have provided a method for use in a wellbore having a plurality of target completion intervals, comprising: (a) running a casing, having a plurality of casing valves and at least one flapper valve formed therein, such that each of the plurality of casing valves is closed and proximate one of the target completion intervals, and each of the at least one flapper valves is open and positioned above one of the plurality of casing valves; (b) cementing the casing within the wellbore; (c) opening one of the plurality of casing valves with a shifting tool; (d) breaking down the target completion interval proximate the opened casing valve; (e) treating the target completion interval; (f) closing the flapper valve immediately above the opened casing valve, using the shifting tool; (g) repeating (c) through (f) for each of the remaining plurality of target completion intervals, excluding the last of such intervals; and (h) repeating (c) through (e) for the last of the plurality of target completion intervals; wherein the order of opening the target completion intervals is from the lowest to the highest.

In some exemplary embodiments of the present invention, we have provided a method of completing a well, the well having a wellbore, the wellbore penetrating a plurality of target completion intervals, comprising: (a) running a casing, having a plurality of casing valves and at least one flapper valve formed therein, such that each casing valve is proximate one of the target completion intervals and each flapper valve is positioned above one of the casing valves, each flapper valve being in an open position, each flapper valve having closing mechanism and a profile, the wellbore forming an annulus about at least part of the casing proximate the target completion intervals, each casing valve having a plurality of ports for fluid flow into the casing valve interior, each casing valve further having a shifting sleeve, the shifting sleeve having an end, the shifting sleeve blocking each of the plurality of ports until the shifting sleeve end is moved past each such blocked port, the shifting sleeve further having a profile; (b) cementing the casing such that cement fills substantially all the wellbore annulus proximate the target completion intervals, the cement substantially blocking at least one of the plurality of ports on each of the casing valves; (c) opening one of the casing valves by engaging the shifting sleeve profile with a shifting tool and moving the shifting tool, whereby the shifting tool moves the engaged shifting sleeve profile and the shifting sleeve, the movement moving the shifting sleeve end past the at least one of the plurality of ports that is substantially blocked by cement; (d) breaking down the target completion interval by applying pressure through a casing fluid to fracture the cement substantially blocking the at least one port on the casing valve and the target completion interval, the fracture enabling fluid communication between the target completion interval and the casing valve interior; (e) isolating the fractured target completion interval by engaging the flapper valve profile with the shifting tool and moving the profile, the profile movement causing the flapper valve closing mechanism to close the flapper valve, the flapper valve closed being the flapper valve positioned above the casing valve that is proximate the fractured target completion interval; (f) repeating (c) through (e) for each of the remaining plurality of target completion intervals, excluding the last of such intervals; and (g) repeating (c) through (d) for the last of the plurality of target completion intervals.

In some exemplary embodiments of the present invention, the method further comprises: (d') treating each of the target completion intervals after breaking down the target completion interval. In some exemplary embodiments of the present invention, the treating comprises a frac job.

In some exemplary embodiments of the present invention, the method further comprises: positioning the shifting tool to a position above the uppermost of all the plurality of casing valves and flapper valves prior to treating.

In some exemplary embodiments of the present invention, the method further comprises: (h) optionally, isolating the subsequent target completion interval.

In some exemplary embodiments of the present invention, the method further comprises: initiating production by opening the flapper valves, allowing fluids to enter the casing through the casing valves and move through the opened flapper valves.

In some exemplary embodiments of the present invention, the shifting tool has an engagement member and the shifting tool is hydraulically operable to alternately move the engagement member from a retracted position to an extended position, and engaging the casing valve profile with a shifting tool comprises: running the shifting tool through the casing valve interior until the shifting tool engagement member is below the shifting sleeve profile; hydraulically moving the shifting tool engagement member from the retracted to the extended position; pulling the shifting tool until the extended engagement member engages the shifting sleeve profile and moves the shifting sleeve, and hydraulically moving the shifting tool engagement member from the extended to the retracted position; and, engaging the flapper valve profile with a shifting tool comprises: hydraulically moving the shifting tool engagement member from the retracted to the extended position, pulling the shifting tool upward through the flapper valve until the extended engagement member engages the flapper valve profile and closes the flapper valve, and hydraulically moving the shifting tool engagement member from the extended position to the retracted position.

In some exemplary embodiments of the present invention, the casing has an interior, the interior having a cross-sectional area, and the shifting sleeve interior has a minimum cross-sectional area at least as large as the casing interior's cross-sectional area, and further the shifting sleeve profile is positioned completely outside the shifting sleeve interior minimum cross-sectional area; and further the flapper valve has an interior, the flapper valve interior having a minimum cross-sectional area at least as large as the casing interior's cross-sectional area, and further the flapper valve profile is positioned completely outside the flapper valve interior minimum cross-sectional area.

In some exemplary embodiments of the present invention, isolating the fractured target completion interval comprises: if the flapper valve does not close, placing a sand plug within the casing and casing valve, proximate the fractured target completion interval, such that fluid flow into and out of the casing valve ports is substantially prevented.

In some exemplary embodiments of the present invention, we have provided a method of completing a well, the well having a wellbore, the wellbore penetrating a plurality of target completion intervals, comprising: (a) running a casing, having a plurality of casing valves formed therein, such that each casing valve is proximate one of the target completion intervals, the wellbore forming an annulus about at least part of the casing proximate the target completion intervals, each casing valve having a longitudinal axis, an interior and a plurality of ports for fluid flow into the casing valve interior, the plurality of ports being spaced circumferentially about the valve, each casing valve further having a shifting sleeve, the shifting sleeve having an end, the shifting sleeve blocking each of the plurality of ports until the shifting sleeve end is moved past each such blocked port; (b) cementing the casing such that cement fills substantially all the wellbore annulus proximate the target completion intervals, the cement substantially blocking at least one of the plurality of ports on each of the casing valves; (c) opening one of the casing valves by moving the shifting sleeve end past the at least one of the plurality of ports that is substantially blocked by cement, the movement being substantially linear along the casing valve longitudinal axis; (d) breaking down the proximate target completion interval by applying pressure through a casing fluid to fracture the cement substantially blocking the at least one port on the casing valve and the target completion interval, the fracture enabling fluid communication between the target completion interval and the casing valve interior; (e) isolating the fractured target completion interval; (f) repeating (c) through (e) for each of the remaining plurality of target completion intervals, excluding the last of such intervals; and (g) repeating (c) through (d) for the last of the plurality of target completion intervals.

In some exemplary embodiments of the present invention, the well is completed by eliminating the isolation of the isolated target completion intervals, allowing fluids to enter the casing through the casing valves. In some exemplary embodiments of the present invention, the well is completed by opening the flapper valves, allowing fluids to enter the casing through the casing valves and move through the opened flapper valves.

In some exemplary embodiments of the present invention, the method further comprises: (h) optionally, isolating the subsequent target completion interval.

In some exemplary embodiments of the present invention, the method further comprises: (d') treating each of the target completion intervals after breaking down the target completion interval. In some exemplary embodiments of the present invention, the treating comprises a frac job.

In some exemplary embodiments of the present invention, running a casing having a plurality of casing valves further comprises: running a casing having a plurality of flapper valves such that each flapper valve is positioned above one of the casing valves, each flapper valve being in an open position, thereby facilitating fluid communication therethrough, and isolating the fractured target completion interval further comprises: closing the flapper valve that is positioned above the casing valve that is proximate the fractured target completion interval. In some exemplary embodiments of the present invention, the shifting sleeve in each of the plurality of casing valves has an interior and a profile positioned circumferentially about the shifting sleeve interior, and opening each of the plurality of casing valves comprises: engaging the profile with a shifting tool and moving the shifting tool, whereby the shifting tool moves the engaged shifting sleeve profile and the shifting sleeve. In some exemplary embodiments of the present invention, the shifting tool has an engagement member and the shifting tool is hydraulically operable to alternately move the engagement member from a retracted position to an extended position, and engaging the profile with a shifting tool comprises: running the shifting tool through the casing valve interior until the shifting tool engagement member is below the shifting sleeve profile; hydraulically moving the shifting tool engagement member from the retracted to the extended position; pulling the shifting tool until the extended engagement member engages the shifting sleeve profile and moves the shifting sleeve, and hydraulically moving the shifting tool engagement member from the extended to the retracted position. In some exemplary embodiments of the present invention, each flapper valve has a closing mechanism and a profile, and closing each of the plurality of flapper valves comprises: hydraulically moving the shifting tool engagement member from the retracted to the extended position, pulling the shifting tool through the flapper valve until the extended engagement member engages the flapper valve profile and closes the flapper valve, and optionally, hydraulically moving the shifting tool engagement member from the extended position to the retracted position.

In some exemplary embodiments of the present invention, the method further comprises: (d') positioning the shifting tool to a position above the uppermost of all the plurality of casing valves and flapper valves, and treating each of the target completion intervals after breaking down the target completion interval.

In some exemplary embodiments of the present invention, the casing has an interior, the interior having a cross-sectional area, and the shifting sleeve interior has a minimum cross-sectional area at least as large as the casing interior's cross-sectional area, and further the shifting sleeve profile is positioned completely outside the shifting sleeve interior minimum cross-sectional area. In some exemplary embodiments of the present invention, the flapper valve has an interior, the flapper valve interior having a minimum cross-sectional area at least as large as the casing interior's cross-sectional area, and further the flapper valve profile is positioned completely outside the flapper valve interior minimum cross-sectional area.

In some exemplary embodiments of the present invention, isolating the fractured target completion interval comprises: placing a sand plug within the casing and casing valve, proximate the fractured target completion interval, such that fluid flow into and out of the casing valve ports is substantially prevented.

In some exemplary embodiments of the present invention, the well has a substantially horizontal wellbore portion, the horizontal wellbore portion has a lower side positioned beneath the casing valve, and the target completion interval is in the horizontal wellbore portion, and at least one of the casing valves lies on the wellbore lower side and at least one of the plurality of casing valve ports is proximate the wellbore lower side, such that the cement between such at least one port and the wellbore is substantially less than the cement between at least one other of the plurality of casing valve ports. In some exemplary embodiments of the present invention, the casing comprises two casing joints attached proximate each of the casing valves lying on the wellbore lower side, the casing valve elevating at least a portion of the two casing joints above the wellbore lower side.

In some exemplary embodiments of the present invention, we have provided a method of completing a well, the well having a wellbore, the wellbore penetrating a target completion interval, comprising: running a casing, having a casing valve formed therein, such that the casing valve is proximate the target completion interval, the wellbore forming an annulus about at least part of the casing proximate the target completion interval, the casing valve having a longitudinal axis, an interior and a plurality of ports for fluid flow into the casing valve interior, the plurality of ports being spaced circumferentially about the casing valve, the casing valve having a shifting sleeve, the shifting sleeve having an end, the shifting sleeve blocking each of the plurality of ports until the shifting sleeve end is moved past each such blocked port; cementing the casing such that cement fills substantially all the wellbore annulus proximate the target completion interval, the cement substantially blocking at least one of the plurality of ports; opening the casing valve by moving the shifting sleeve end past the at least one of the plurality of ports that is substantially blocked by cement, the movement being substantially linear along the casing valve longitudinal axis; and breaking down the proximate target completion interval by applying pressure through a casing fluid to fracture the cement substantially blocking the at least one port on the casing valve and the target completion interval.

In some exemplary embodiments of the present invention, the method further comprises: treating the target completion intervals after breaking down the target completion interval. In some exemplary embodiments of the present invention, the treating comprises a frac job.

In some exemplary embodiments of the present invention, the shifting sleeve has an interior and a profile positioned circumferentially about the shifting sleeve interior, and opening the casing valve comprises: engaging the profile with a shifting tool and moving the shifting tool, whereby the shifting tool moves the engaged shifting sleeve profile and the shifting sleeve. In some exemplary embodiments of the present invention, the shifting tool has an engagement member and the shifting tool is hydraulically operable to alternately move the engagement member from a retracted position to an extended position, and, engaging the profile with a shifting tool comprises: running the shifting tool through the casing valve interior until the shifting tool engagement member is below the shifting sleeve profile; hydraulically moving the shifting tool engagement member from the retracted to the extended position; pulling the shifting tool until the extended engagement member engages the shifting sleeve profile and moves the shifting sleeve, and hydraulically moving the shifting tool engagement member from the extended to the retracted position. In some exemplary embodiments of the present invention, the casing has an interior, the interior having a cross-sectional area, and the shifting sleeve interior has a minimum cross-sectional area at least as large as the casing interior's cross-sectional area, and the shifting sleeve profile is positioned completely outside the shifting sleeve interior minimum cross-sectional area.

In some exemplary embodiments of the present invention, the method further comprises: locking the shifting sleeve such that the casing valve is locked in an open position.

In some exemplary embodiments of the present invention, the plurality of ports further comprises 30 ports, the 30 ports being positioned in six rows, the six rows being spaced at approximately 60 degrees apart with respect to the casing valve longitudinal axis.

In some exemplary embodiments of the present invention, the cement is acid soluble, and the method further comprises exposing the cement that substantially blocks at least one port to an acid solution, such that the cement no longer prevents fluid flow through the port.

In some exemplary embodiments of the present invention, the well has a substantially horizontal wellbore portion, the horizontal wellbore portion has a lower side positioned beneath the casing valve, and the target completion interval is in the horizontal wellbore portion, and the casing valve lies on the wellbore lower side and at least one of the plurality of casing valve ports is proximate the wellbore lower side, such that the cement between such at least one port and the wellbore is substantially less than the cement between at least one other of the plurality of casing valve ports. In some exemplary embodiments of the present invention, the casing comprises two casing joints attached proximate the casing valve lying on the wellbore lower side, the casing valve elevating at least a portion of the two casing joints above the wellbore lower side.

The foregoing and other objects, features and advantages of the invention will be apparent from the following more particular descriptions of exemplary embodiments of the invention as illustrated in the accompanying drawings wherein like reference numbers generally represent like parts of exemplary embodiments of the invention.

DETAILED DESCRIPTION OF EXEMPLARY EMBODIMENTS

Figure 1:
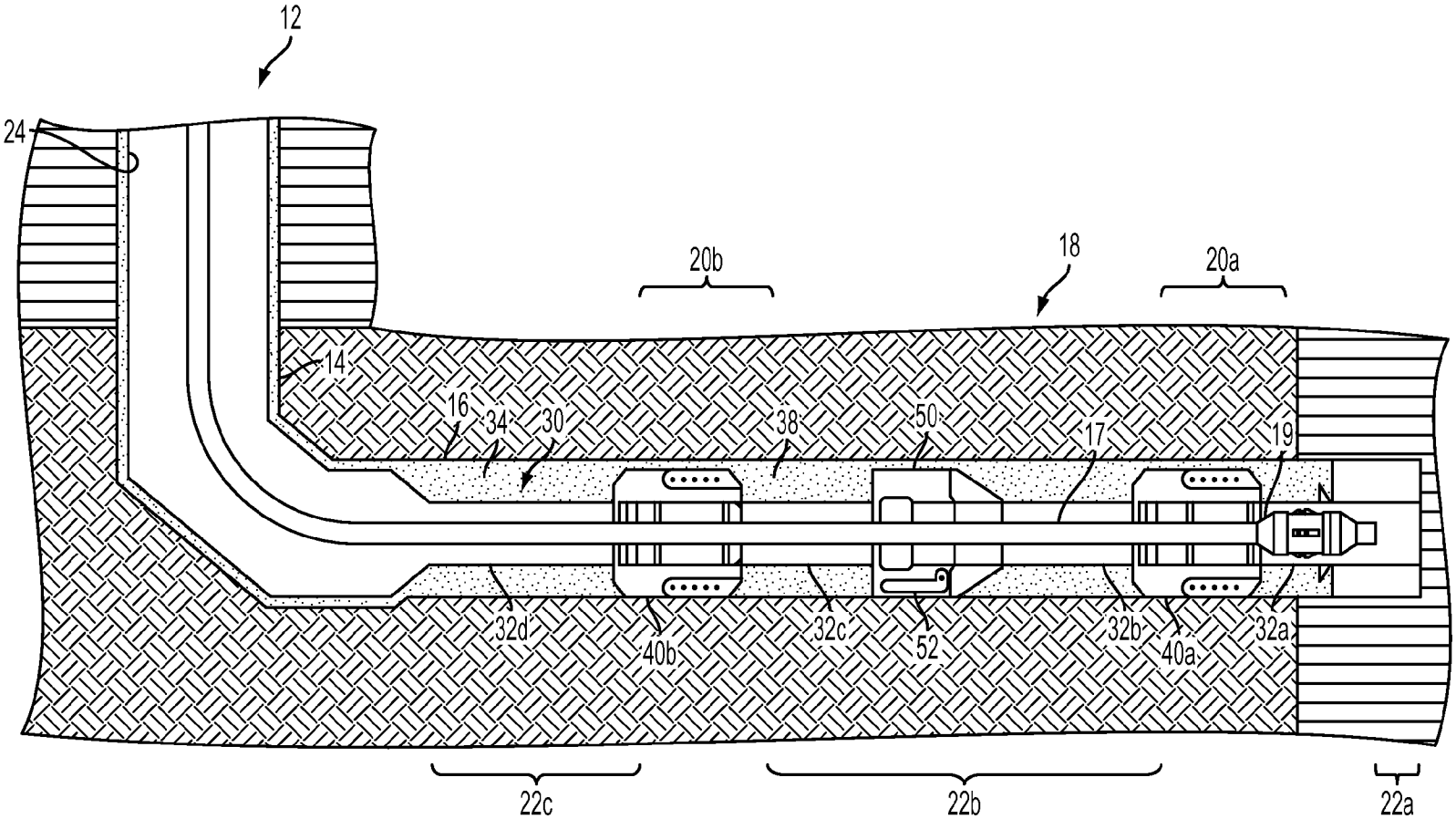
FIG. 1 depicts a cross-section of a portion of a horizontal wellbore with two frac gates and a flapper valve positioned between the frac gates.

The following discussion describes exemplary embodiments of the invention in detail. This discussion should not be construed, however, as limiting the invention to those particular embodiments. Practitioners skilled in the art will recognize numerous other embodiments as well.

DEFINITIONS

Unless specifically indicated otherwise, terms such as "up," "upward," "down," "downward," "highest," "lowest," "above," "below," and other terms suggesting a vertical movement, position or relationship, as used herein, refer to positions along, and/or with respect to, the wellbore axis, with the distal end of the wellbore being considered the lowermost, and the surface end being considered the uppermost. Accordingly, movement. "up" is toward the surface within the wellbore, although the true path may actually be horizontal, or even downward, with respect to the surface. Similarly, a point "lower" than another point would be farther from the surface, along the wellbore axis, although the points may actually be on an equal plane with respect to the surface.

The term "running," as used herein, refers to moving downward into the well with whatever is indicated as being run. The term "pulling," as used herein, refers to moving upward within a well with whatever is indicated as being pulled.

The term "well," as used herein, refers to holes drilled vertically, at least in part, and may also refer to holes drilled with deviated, highly deviated, and/or horizontal sections of the wellbore. The term also includes wellhead equipment, surface casing, intermediate casing, and the like, typically associated with oil and gas wells.

The term "blocking," as used herein, refers to cement substantially interfering with fluid flow through a port on the frac gate of the present invention. It can, but does not necessarily, include entry of the cement into the port being blocked.

The term "target completion interval," as used herein, refers to a portion of a subterranean formation from which an operator wishes to allow flow of fluids into the well. The term includes both a single formation having one or more such portions (typically the case in a horizontal well) and multiple formations penetrated by the wellbore (typically the case in a vertical well), with each formation being a targeted portion.

The term "frac job," as used herein, refers to treatment of a hydrocarbon formation, whereby fluids are injected into the formation causing fractures to enlarge. In some instances, proppants, such as sand, are included in the injection fluid, the proppants being retained within the enlarged fractures, such that the fractures are prevented from fully closing after the injection of the fluid ceases.

The terms "break down," "breaking down," and the like, as used herein, refer to applying hydraulic pressure to a target completion interval, and to the cement, if any, between the casing and the target completion interval in the area proximate perforations, or, the ports in the case of a frac gate, as described herein. The pressure is applied until the target completion interval fractures, and the cement fractures, the fracture being a conditioning step in preparation for a frac job, with no proppants being injected.

DETAILED DESCRIPTION

Turning now to FIG. 1, wherein an exemplary embodiment of the present invention is schematically illustrated (not to scale) in relation to a well 12, the wellbore 14, and a substantially horizontal portion 16 of the wellbore. Also illustrated is a subterranean formation 18 having targeted completion intervals 20*a-b* and non-completion intervals 22*a-c*. Conventional intermediate casing 24 such as 4.5 inch O.D., 4 inch I.D., 11.6 pound, P-110 grade casing, is present in the vertical section 26 of the wellbore, from which conventional production casing 30 such as 3.5 inch O.D., 3 inch I.D., 9.3 pound, P-110 grade casing, is suspended and utilized for the horizontal wellbore. In the exemplary embodiment of FIG. 1, an exemplary method of completion is further shown to include running the production casing 30 with at least two frac gates 40*a-b* (examples of "casing valves" as that term is used herein) and at least one flapper valve 50 in an open position.

Conventional casing joints or joint sections 32 (also referred to herein as "casing members") are used to position the frac gates proximate the predetermined target completion intervals 20*a-b*, with a small number of casing joints being installed between each frac gate 40*a-b* and the flapper valve 50 above it. The flapper valve is placed between targeted completion intervals 20*a-b*. The flapper valve 50, when open, allows fluid flow through the casing 30. A suitable flapper valve for purposes of the exemplary embodiments of the present invention is described in United States Application No. 2006/0124311, published Jun. 15, 2006, which is incorporated herein by reference for all purposes.

In exemplary embodiments of the type shown in FIG. 1, the horizontal wellbore 16 forms an annulus 34 about all or nearly all of the casing 30, the frac gates 40*a-b* and the flapper valve 50. In the horizontal wellbore 16, the larger O.D. frac gates and flapper valve 50 will rest against the lower side 36 (that is, lower with respect to true vertical) of the horizontal wellbore 16. When the production casing 30 is cemented, the annulus 34 is filled with cement 38, although the cement is minimalized or eliminated in areas where the frac gates 40*a-b* and flapper valve 50 rest against the lower side 36. The frac gates 40*a-b* and flapper valve 50 also elevate the casing joints 32 above the wellbore lower side 36.

Turning now to FIGS. 2-10, wherein an exemplary embodiment of the frac gate 40*a* of the present invention is shown to have a tubular body, along a longitudinal axis 42, with a bottom sub 60 member and a top sub 80 member, within which is contained a shifting sleeve 100 member. As shown in further detail in FIGS. 2-4, the bottom sub 60 has a first end 62 with male threads for threadably attaching to the production casing joint string 32 (at a collar), and a second end 64 with female threads for threadably attaching to the male threads 82 of the top sub 80. The bottom sub also has an interior surface 66 forming a first bore 68 and a coaxial second bore 70, the second bore having a larger minimum cross-sectional area than the first bore. An upward facing shoulder 72 is formed at the transition from the first bore 68 to the second bore 70.

Figure 2:
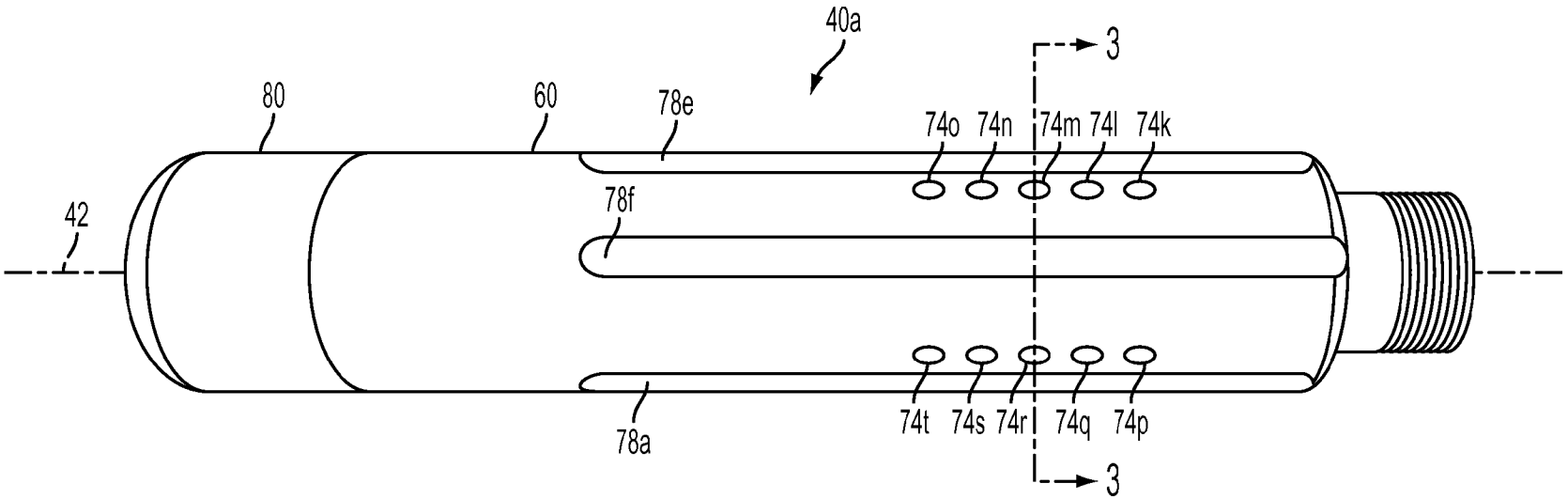
FIG. 2 depicts an exemplary embodiment of the present invention.
Figure 3:
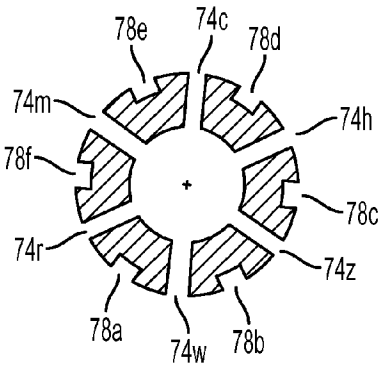
FIG. 3 depicts a cross section of the bottom sub of an exemplary embodiment of the present invention cut at section line 3-3 as shown on FIG. 2.
Figure 4:
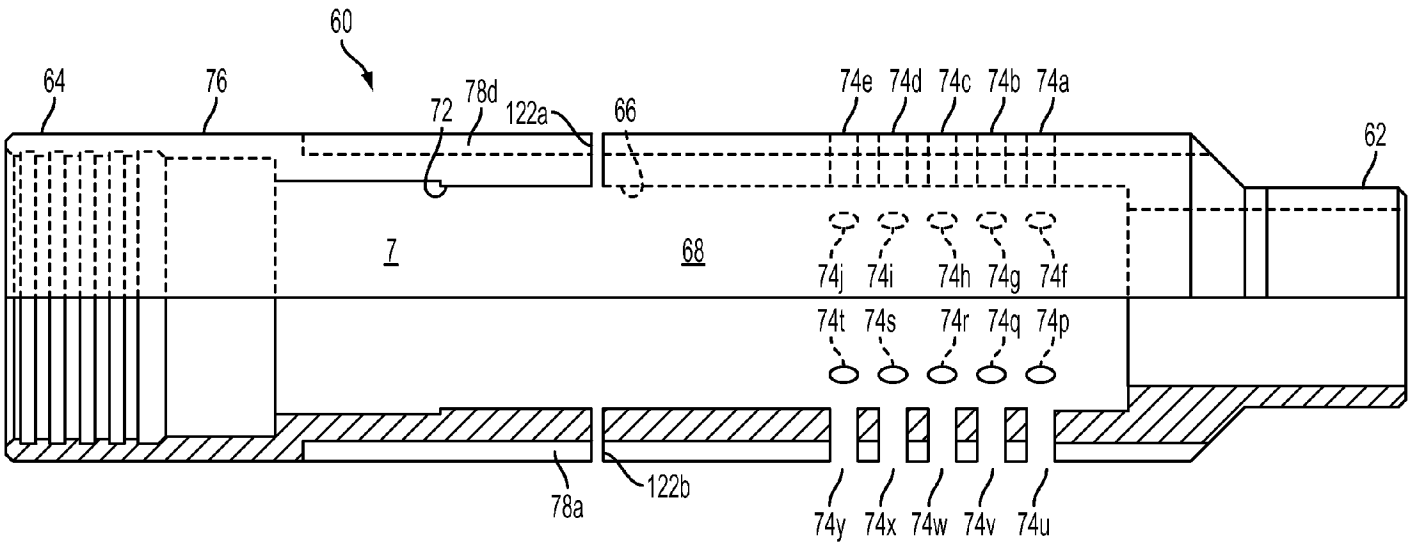
FIG. 4 depicts a partial sectional side view of the bottom sub of an exemplary embodiment of the present invention.
Figure 5:
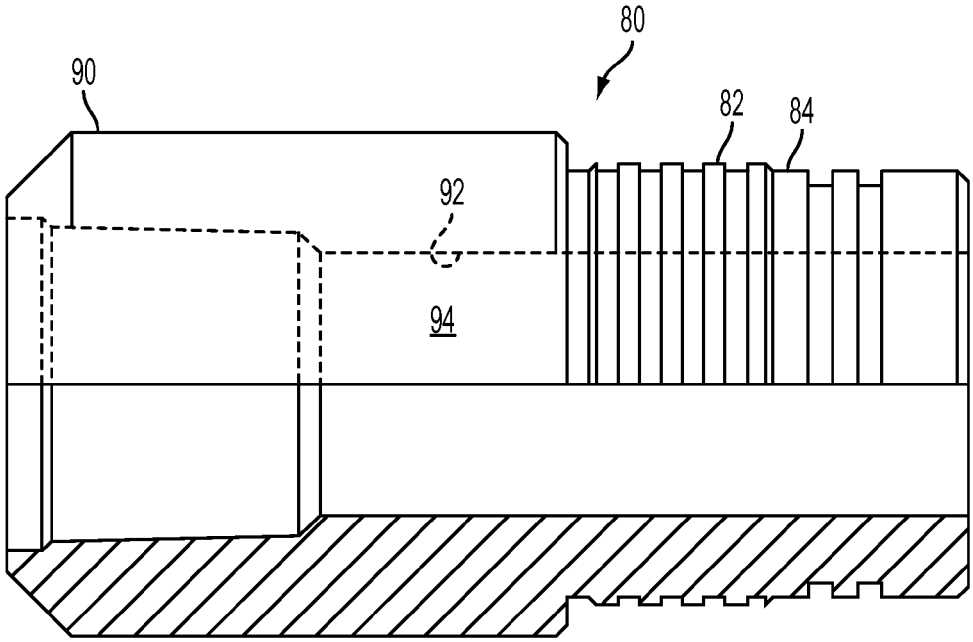
FIG. 5 depicts a partial sectional view of the top sub of an exemplary embodiment of the present invention.
Figure 6:
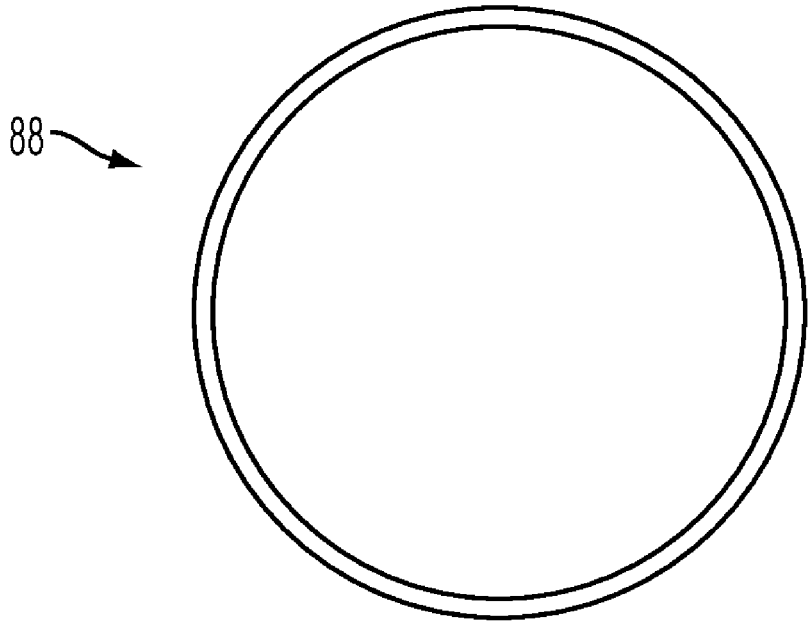
FIG. 6 depicts a side view of a conventional O-ring sealing member used in various positions in exemplary embodiments of the present invention.

In some exemplary embodiments of the type shown in FIGS. 2-10, and as shown representatively in FIGS. 2-4, ports 74*a-z* (26 of 30 shown) extend from the bottom sub interior surface 66 to the exterior surface 76 of the bottom sub 60. The ports in such exemplary embodiments are in six rows spaced equally (approximately 60 degrees) about the circumference of the bottom sub, with each row having an aligned counterpart row such that the ports in the aligned rows are coaxial, with one port from each row lying in a plane substantially perpendicular to the longitudinal axis 42. In some exemplary embodiments of the type shown in FIGS. 2-4, the ports are 0.5 inch in diameter.

In some exemplary embodiments of the type shown in FIGS. 2-4, the bottom sub 60 has six channels 78*a-f* cut in the bottom sub exterior 76, running parallel to the longitudinal axis 42 and terminating prior to the female threads on the bottom sub second end 64, but after all ports 74*a-z*. The channels 78*a-f* are equally spaced about the circumference of the bottom sub, and alternately spaced between the six rows of ports 74*a-z*.

Turning again to FIGS. 5-6, the top sub 80 of the exemplary embodiments of the type shown in FIGS. 2-10, is shown to include a first end 84 with male threads 82 for threadably attaching to the bottom sub second end 62. Two conventional O-rings 88 are positioned in grooves 86*a-b* and sealably bear on the bottom sub interior surface 66 when the top sub 80 is attached to the bottom sub 60. The top sub second end 90 has female threads for threadably attaching to one of the casing joint sections 32. The top sub has an interior surface 92 that forms a bore 94. The bore 94 has an interior cross-sectional area at least as great as the minimum cross-sectional area of the production casing 30.

Turning again to FIGS. 7-10, the shifting sleeve 100 of the exemplary embodiments of the type shown in FIGS. 2-10, is closely received within the bottom sub first bore 68 and positioned for movement between a first position and a second position within the bottom sub 60 along the bottom member longitudinal axis 42. The shifting sleeve has an up end 102 and a down end 104 and a substantially solid exterior surface 106, such that when the shifting sleeve is in the first position the ports 74*a-z* are closed by the shifting sleeve solid surface, and when in a second position the down end 104 is above the ports and the ports are open. A first pair conventional O-rings 88 (FIG. 6) are positioned in grooves 108*a-b* in the exterior surface 106, and a second pair of O-rings 88 are positioned in grooves 10*a-b*. These O-ring pairs are spaced such that, when the sleeve 100 is in the first position, the first pair sealably bears on the bottom sub interior surface 66 downward of the ports 74*a-z*, and the second pair sealably bears on the bottom sub interior surface upward of the ports.

The shifting sleeve 100 has an interior surface 112 forming a sleeve first bore 114 and an enlarged sleeve second bore 116. At the upward end of the sleeve second bore 116 a reduction in bore diameter to the diameter of the first bore 114 creates an interior profile 118. The minimum cross-sectional area of the sleeve first bore is at least as large as the internal diameter of the production casing 30. Near the sleeve second end 102 is a groove 120 which is positioned such that it is beneath the four shear screw holes 122*a-b* (two of four shown) when the shifting sleeve 100 is in the closed first position. The holes are threaded to receive a shearable screw 124 of the type shown in FIG. 9, and when the screws are threadably inserted they terminate in the groove 120. The screws are constructed of materials such that the four screws will shear when a predetermined load (approximately 5,000 lbs.) is applied to the shifting sleeve in an upward direction. Such a load is more than loads that are likely to be encountered as the frac gate 40*a* is run into the wellbore 14, and less than the maximum load that can safely be applied in pulling the shifting sleeve to the open second position.

In some exemplary embodiments, ajar is included in the bottom hole assembly to provide additional shearing force in the event the cement has caused an increase in the amount of upward load required to shear the four screws 124. The Baker Oil Tools HIPP-TRIPPER® is a readily available jar usable for this purpose, and is described in the current Baker Oil Tools Coiled Tubing Solutions handbook (Baker Hughes Incorporated Publication No. BOT-02-9242 4M, July, 2003). In some exemplary embodiments, the increased load requirement due to cement is addressed by reducing the number of screws 124 to less than four, such as two.

Figure 10:
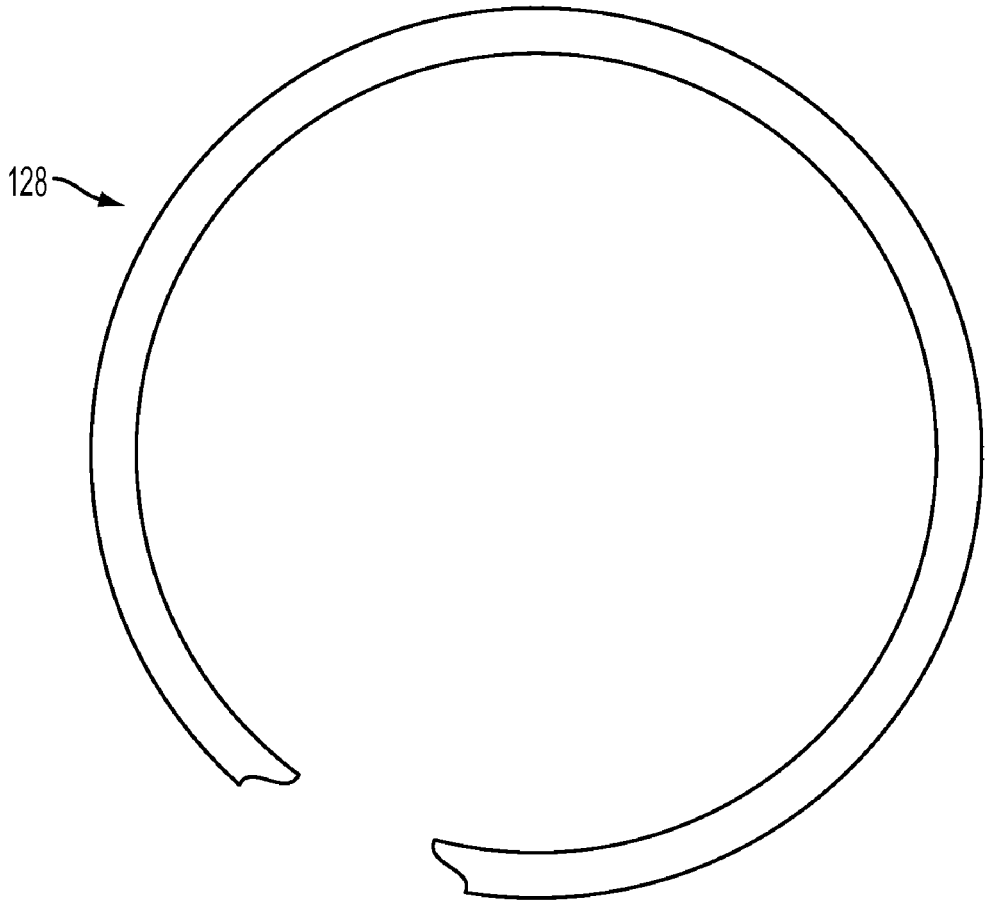
FIG. 10 depicts a top view of a locking ring of an exemplary embodiment of the present invention.

Slightly upward of the second pair of O-ring grooves 110*a-b* is a groove 126 for receiving a compressible lock ring 128 of the type shown in FIG. 10. During initial insertion of the shifting sleeve 100 into the bottom sub 60, the lock ring 128 is compressed into the lock ring groove 126 until it enters the bottom sub and expands to bear upon the bottom sub interior surface 66 in the bottom sum first bore 114. When the shifting sleeve 100 is later moved to its second position, the lock ring 128 expands to bear upon the bottom sub interior surface 66 in the bottom sub second bore 116. Because of the expansion, the shoulder 72 interferes with any movement of the lock ring 128 back down to the bottom sub first bore 114, thus preventing the sleeve 100 from re-closing any of the ports 74*a-z*. In addition to, or in lieu of, the lock ring 128, a bevel 130 is formed on the shifting sleeve second end 102. In some well environments and treatment pressures, the shifting sleeve 120 is retained in the open second position due to treatment fluids having a smaller profile to push against on the shifting sleeve second end 102, the retention force being provided by the two pairs of O-rings 88 on the shifting sleeve bearing against the bottom sub interior surface 66.

Turning again to FIG. 8. The ports 74*a-z* on the frac gate 40*a* are openable when the shifting sleeve 100 is moved upwardly, within the bottom sub 60 from a first position to a second position. This movement is initiated using a shifting tool, preferably a hydraulically activated shifting tool 19 on a workstring 17, as shown in FIG. 1, that is capable of hydraulically extending a shifting tool key, or "dog," (also referred to herein as a shifting tool "engagement member") that engages the shifting sleeve profile 118 as the shifting tool is pulled through the shifting sleeve. Once engaged with the profile 118 the shifting tool continues to move the shifting sleeve to the open second position. When the sleeve is in the second position, the shifting tool key is hydraulically retractable, thus disengaging the sleeve profile 118. The retraction of the shifting tool key allows the shifting tool to be pulled through a flapper valve 50 without engaging the closing mechanism of the flapper valve. This is desirable because it is typically a practice to pull the shifting tool back into the vertical casing, prior to treating the completion target interval that was exposed when the frac gate 40*a* was opened. A hydraulically activated shifting tool is described in a Society of Petroleum Engineers paper entitled "Selective Production of Horizontal Openhole Completions Using ECP and Sliding Sleeve Technology," by Jesse J. Constantine (SPE 55618), which is incorporated herein by reference. The tool described by the paper is suitable for the above-described operation of the frac gate 40*a*, with only a small modification to the keys to provide a proper engagement with the shifting sleeve profile 118 of the present invention. Another suitable tool is the "4.5 Frac Shifting Tool" manufactured by Team Oil Tools, Inc. and widely used in wells in the north-central Texas Barnett Shale.

In some exemplary embodiments of the present invention, the bottom sub 60, top sub 80 and shifting sleeve 100 are constructed from 4140 alloy steel, 4340 alloy steel, Inconel, chrome, and other suitable metals. In some exemplary embodiments, the shifting sleeve is nitrided for erosion resistance during high pressure, high velocity treatments. In some exemplary embodiments the shifting sleeve is constructed from ion nitrided 4140 alloy steel and is approximately 0.4435 inches thick. In some exemplary embodiments, the shifting sleeve 100 is constructed from materials having a higher burst resistance rating than the production casing 30. In some exemplary embodiments, the shifting sleeve 100 is constructed from materials having a higher collapse resistance rating than the production casing 30.

Exemplary embodiments of the apparatus and methods of the present invention are schematically illustrated in FIG. 1 for a well 12 having multiple (2) target completion intervals 20*a-b* separated by non-completion intervals 22*a-c* in the horizontal wellbore. Production casing 30 is run, and frac gates 40*a-b* and flapper valve 50 are spaced, as described above, such that frac gates are proximate the target completion intervals, such spacing accomplished by the use of the production casing 30 and casing joint sections 32*a-h*. The flapper valve 50 is positioned between the two frac gates 40*a-b*. The operator cements the casing joint sections 32, frac gates 40*a-b*, and flapper valve 50 into the horizontal wellbore, substantially blocking the frac gates from the formation, including the frac gates. The operator circulates drilling mud out of the well and replaces with completion fluid, then pulls the drill string from the well. A coiled tubing unit is rigged up and a correlation run is made with coiled tubing to determine a reference point for later depth measurements. In the next run, a hydraulically activated shifting tool is placed on the end of the coiled tubing and run in the hole. A running weight is established by pulling up approximately 100-200 feet. The shifting tool is lowered beneath frac gate 40*a* which is proximate the lowest target completion interval. Pressure is applied through completion fluid in the coiled tubing which actuates the shifting tool, causing keys on the shifting tool to move from the retracted to the extended position. The shifting tool is pulled through the frac gate 40*a* until the shifting sleeve profile 118 is located, with further pulling moving the shifting sleeve 100 from its first position (blocking the frac gate ports 74*a-z*) to its second position (opening the frac gate ports). As the shifting sleeve moves to its second position, the lock ring 128 expands into the bottom sub second bore 70 (where shoulder 72 prevents any later movement of the shifting sleeve back to its first position.) In the second position the shifting sleeve end 104 is moved completely beyond the ports 74*a-z*, leaving the opened ports exposed to the formation and/or cement at the target completion interval 20*a*, depending on whether the exposed row of ports (or rows of ports) is on the portion of the frac gate that is resting on the horizontal wellbore lower side, or on other portions that are surrounded by cement in the horizontal wellbore annulus. Pressure is applied through production casing fluids to break down the cement blocking at least some of the ports and the target completion interval 20*a*.

Once the cement and target completion interval has been broken down, the operator hydraulically actuates the shifting tool to retract the keys (such as by relieving the pressure in the coiled tubing), and pulls the shifting tool into the vertical portion of the well and initiates a treatment of the target completion interval 20*a* (such as a frac job). At the conclusion of the treatment, the shifting tool is lowered to a position below the flapper valve 50, and the shifting tool is hydraulically actuated to extend the keys. As the shifting tool is then pulled through the flapper valve, the extended keys engage the closing mechanism profile causing the flapper valve flapper 52 to close below the shifting tool, the flapper valve flapper being spring biased to close. Given sufficient pressure in the wellbore above the flapper valve, the flapper will remain closed, preventing formation fluids from the target completion interval 20*a* from flowing through the flapper valve 50.

The operator then hydraulically actuates the retraction of the shifting tool keys and pulls the shifting tool to a position below the next frac gate 40*b*, where the shifting tool is hydraulically actuated to extend the keys. Once this is accomplished the shifting tool is pulled through the second frac gate 40*b* until the profile 118 is located, and then the shifting sleeve 100 is moved from the first to the second position. In the second position the shifting sleeve no longer closes the ports 74*a-z*. As was done for the lowest target completion interval 20*a*, the operator applies pressure through production casing fluids to down the cement blocking at least some of the ports and the target completion interval 20*a*, and once the cement and target completion interval 20*b* has been broken down, the operator hydraulically actuates the shifting tool to retract the keys (such as by relieving the pressure in the coiled tubing), and pulls the shifting tool into the vertical portion of the well and initiates a treatment of the target completion interval 20*b* (such as a frac job). At this point, the flapper valve 50 is closed, both frac gates 40*a-b* have all ports 74*a-z* open, the cement that originally blocked at least some of the frac gates ports 74*a-z* has been broken down, the target completion intervals 20*a-b* that are proximate the frac gates have been broken down and treated (such as by separate frac jobs), sufficient pressure is being applied through casing fluids to keep the flapper 52 closed, such that fluids from the lowest target completion interval 20*a* are prevented from flowing through the flapper valve 50, and the lowest target completion interval 20*a* is isolated from the next highest target completion interval 20*b*. Once the casing fluid pressure acting on the flapper valve flapper 52 is reduced by the operator to a level below the formation pressure of the lowest target completion interval 20*a*, the flapper 52 will open and fluids from the lowest target completion interval 20*a* will flow through the lowest frac gate 40*a*, through the casing section 32 between the lowest frac gate 40*a* and the flapper valve 50, through the casing section 32 between the flapper valve and the next highest frac gate 40*b*, where such fluids are commingled with fluids from the next highest target completion interval 20*b* and continue to flow upwardly through the production casing.

In the foregoing example, the operator successfully opened the frac gates 40*a-b* and the flapper valve 50 using the same hydraulically activated shifting tool, and moved the shifting tool through the highest frac gate 40*b* and flapper valve 50 at least four times, and the lowest frac gate at least twice. This is possible because the frac gates 40*a-b* and flapper valve 50 are full bore to correspond with the production casing.

Figure 11:
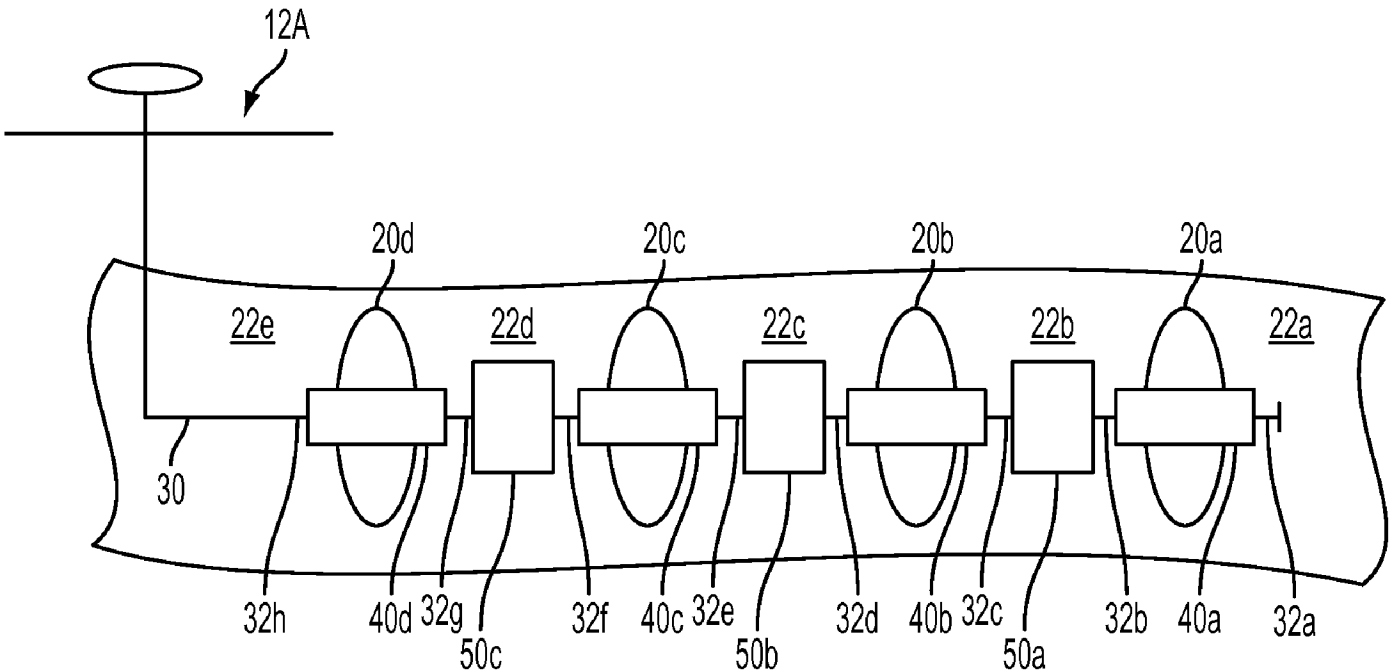
FIG. 11 depicts a cross-section of a portion of a horizontal wellbore with four frac gates and three flapper valves positioned between the frac gates.
Figure 12:
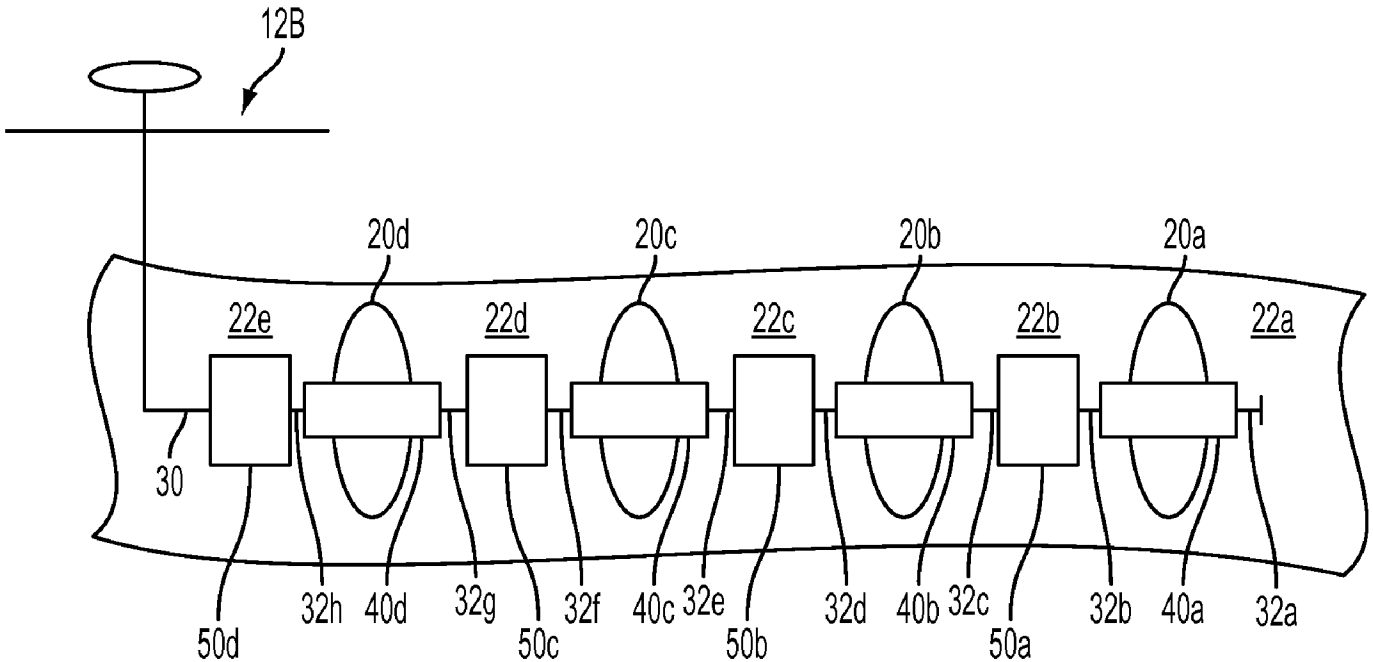
FIG. 12 depicts a cross-section of a portion of a horizontal wellbore with four frac gates and four flapper valves positioned between and/or above the frac gates.

Turning now to FIG. 11, wherein an exemplary embodiment of the present invention is shown, in schematic to comprise a well 12A having multiple (4) target completion intervals 20*a-d*, adjacent non-target completion intervals 22*a-e*, with frac gates 40*a-d* positioned in the casing 30 proximate each such interval. Three flapper valves 50*a-c* are in the casing string and spaced between the frac gates by casing sections 32*a-h*. In an analogous procedure to that described above as to FIG. 1, the operator will lower the shifting tool to a point below the lowest untreated target completion interval, open the frac gate with the shifting tool, break down the cement and target completion interval proximate the frac gate, raise the shifting tool into the vertical casing, treat the target completion interval proximate the newly opened frac gate (such as with a frac job), lower the shifting tool below the flapper valve above the newly treated target completion interval, isolate the newly treated target completion interval by closing the flapper valve with the shifting tool, then opening the next highest frac gate using the shifting tool, and repeating the process until the fourth, and highest target completion interval 20*d* has been treated. Following the treatment of the highest target completion interval 20*d*, the shifting tool will be located in the vertical casing. In some exemplary methods of completion, the operator will lower pressure in the casing fluids such that the flapper valves 50*a-c* will reopen and fluids from the four, now treated, target completion intervals 20*a-d*, will have access to flow through the frac gates 40*a-d*, the flapper valves 50*a-c*, casing sections 32*a-h*, and into the vertical casing. In other exemplary embodiments, as shown schematically for a well 12B in FIG. 12, a flapper valve 50*d* is included during the original running of the casing, frac gates 40*a-d*, and other flapper valves 50*a-c*. In completion methods including the additional flapper valve, the operator will have the option to isolate the highest target completion interval 20*d*, by lowering the shifting tool below the additional flapper valve 50*d*, hydraulically actuating the shifting tool to extend the engagement member such that the profile is engaged as the shifting tool is pulled upward through the additional flapper valve, and the closing mechanism causes the flapper to close. The operator can then proceed to engage in additional up-hole activities while all four target completion intervals are isolated.

In some exemplary embodiments of the type illustrated in FIG. 1, each of thirty frac gate ports 74*a-z* have a cross-sectional area with a diameter of approximately one-half inch. The total cross-sectional area of such ports is approximately 5.88 square inches. In a typical well of the type discussed to this point, the I.D. of the production casing is 3 inches, such that the casing has a cross-sectional area of approximately 7.02 square inches. The combined area of the ports 74*a-z*, through which formation fluids enter the frac gate 40*a-b* is well over 80 percent of the casing area through which fluids exit the frac gate, resulting in only a marginal "choke" effect by the frac gate. In wells using larger casing sizes, some exemplary embodiments will include a larger diameter frac gate with a proportionate increase in either the size or number of ports, or both, such that this favorable ratio of combined port area to casing I.D. area is maintained.

In some exemplary embodiments of the frac gate illustrated in FIGS. 2-10, the shifting sleeve 100 is sized and positioned relative to the top sub 60 and ports 74*a-z*, such that initial linear, non-rotational movement of the shifting sleeve from its first position, to an interim point 1.75 inches upward along the longitudinal axis 42 of the top sub 60, will pull the shifting sleeve down end 104 past the first port 74*a*,74*f*,74*k*,74*p*,74*u* in each of the six rows. As a result, if the sleeve is pulled only 1.75 inches, a malfunction preventing full movement of the shifting sleeve 100 to its second position will not preclude significant function of the frac gate. Similarly, the shifting sleeve 100 need only move linearly approximately 5.5 inches to be in the second position and locked in place with the locking ring 128. No rotation of the shifting sleeve is required, and inadvertent rotation of the sleeve will have no effect on the frac gate performance.

Figure 7:
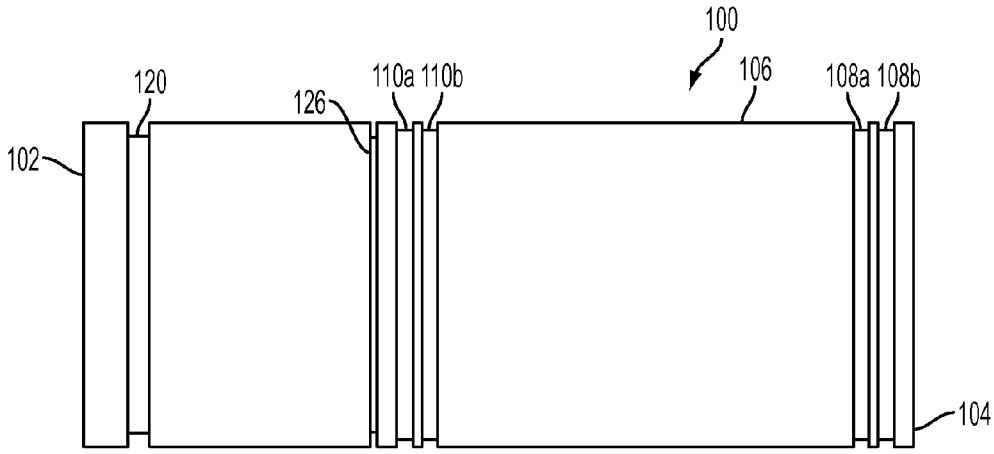
FIG. 7 depicts a side view of a shifting sleeve of an exemplary embodiment of the present invention.
Figure 8:
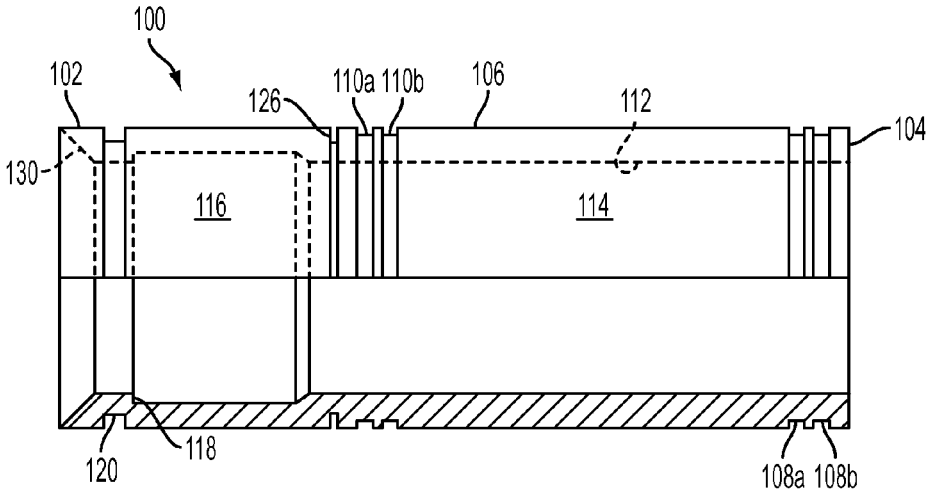
FIG. 8 depicts a partial sectional side view of a shifting sleeve of an exemplary embodiment of the present invention.
Figure 9:
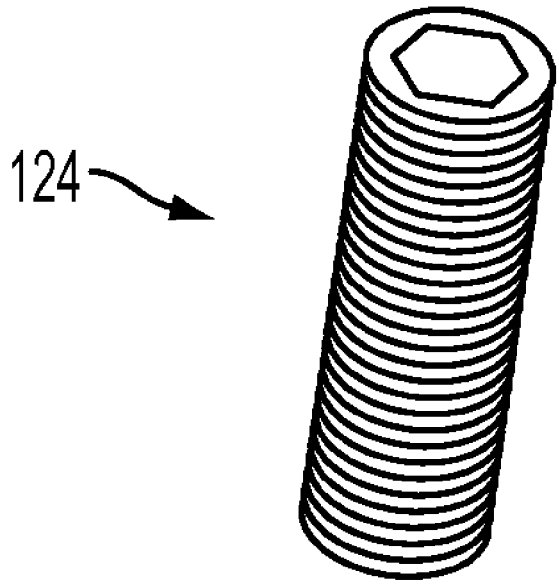
FIG. 9 depicts a prospective view of a shearable set screw of an exemplary embodiment of the present invention.
Figure 13:
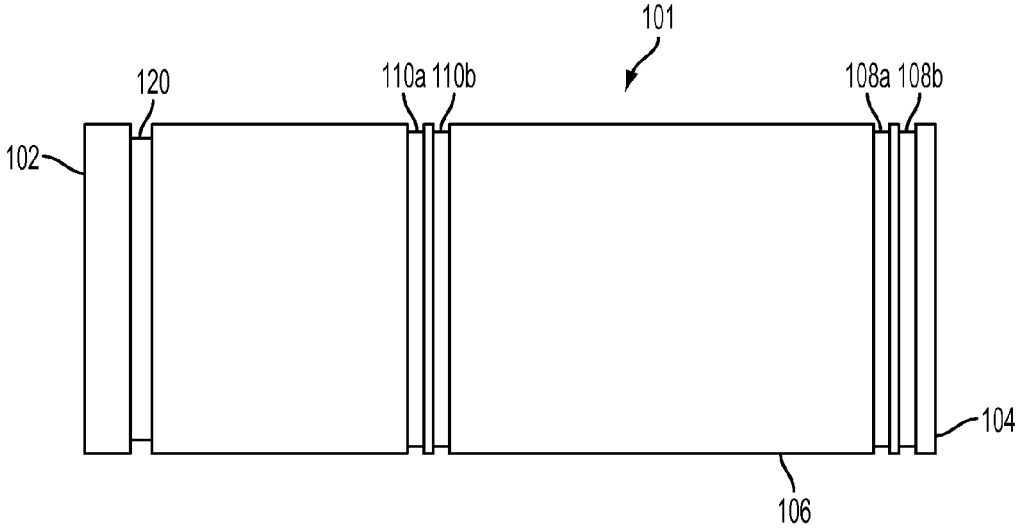
FIG. 13 depicts a side view of a shifting sleeve of an exemplary embodiment of the present invention with no groove for a locking ring.

Turning now to FIG. 13, wherein an exemplary embodiment of a frac gate of the present invention is shown to have a shifting sleeve 101 with no groove for positioning a lock ring (such as the groove 126 shown in FIG. 7, and the lock ring 128 shown in FIG. 10). In some applications, with shallower target completion intervals, lower treating pressures, and the like, the sealing member O-rings 88 in the shifting sleeve grooves 108*a-b*, 110*a-b*, in combination with the beveled profile 130 on the shifting sleeve up end 102 (as shown in FIG. 7), will sufficiently retain the shifting sleeve in the second position during treatment of the adjacent target completion interval, without the lock ring.

In some exemplary embodiments of the type shown in FIG. 1, the operator cements the casing joint sections 32*a-d*, frac gates 40*a-b*, and flapper valve 50 into the horizontal wellbore using acid soluble cement. In the event the operator is unable to break down the cement blocking at least some of the ports 74*a-z*, the operator may spot acid (such as 7.5%-15% water-HCL solution) through the frac gate ports 74*a-z*, such that the acid-soluble cement blocking the ports from the target completion interval is dissolved. After this a second attempt to break down the target completion interval, using pressured production casing fluids, will typically break down the target completion interval in preparation for the ensuing frac job.

Figure 14:
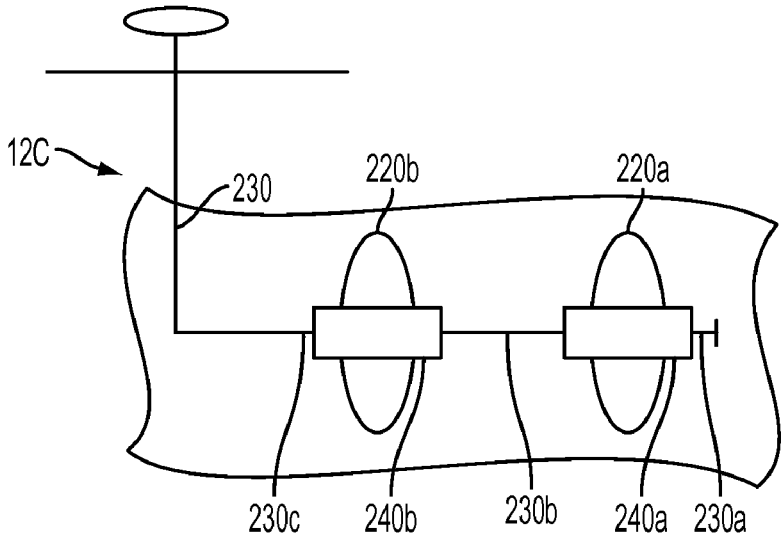
FIG. 14 depicts a cross-section of a portion of a horizontal wellbore with two frac gates and no flapper valves.

Turning now to FIG. 14, wherein an exemplary embodiment of the present invention is shown schematically for a well 12C completion wherein multiple target completion intervals 220*a-b* are penetrated by the wellbore. Casing 230 is run with frac gates 240*a-b* spaced by casing sections 230*a-c*, such that each frac gate is proximate one of the target completion intervals. The casing and frac gates are cemented in place. No flapper valves are included. In this exemplary completion, the operator lowers the shifting tool below the lowest target completion interval 220*a* and opens the ports by moving the shifting sleeve as described above. The operator breaks down the cement and target completion interval, pulls the shifting tool into the vertical casing, and treats the newly opened target completion interval 220*a*, as described above. To isolate the newly treated target completion interval, the operator places ("spots") a sand plug within the casing and frac gate 240*a*, proximate the newly treated target completion interval 220*a*, such that fluid flow into and out of the frac gate ports is substantially prevented. The operator then positions the shifting tool below the next highest frac gate 240*b* and repeats the opening, breaking down, and treating steps.

Figure 15:
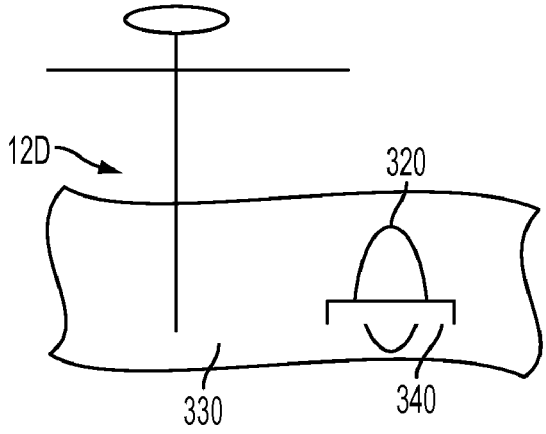
FIG. 15 depicts a cross-section of a portion of a horizontal wellbore with a single frac gates and no flapper valves.

Turning now to FIG. 15, wherein an exemplary embodiment of the present invention is shown schematically for a well 12D completion wherein a single target completion interval 320 is penetrated by the wellbore and a single frac gate 340, of the type shown in FIGS. 2-10 is positioned in the casing 330 proximate the target completion interval. The operator positions a shifting tool below the frac gate and the shifting tool moves the shifting sleeve past the ports 74*a-z* as the shifting tool is pulled through the frac gate. The operator then breaks down the cement and target completion interval, and treats the target completion interval as described above. If isolation of the newly treated target completion interval 320 is desired, the operator places a sand plug in the casing and the frac gate 340, as described above.

Figure 16:
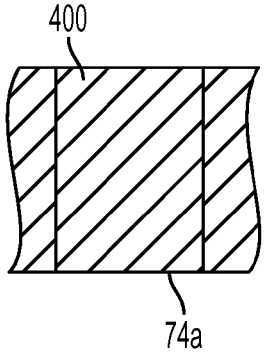
FIG. 16 is a sectional view of a representative frac gate port with grease as a filling material.
Figure 17:
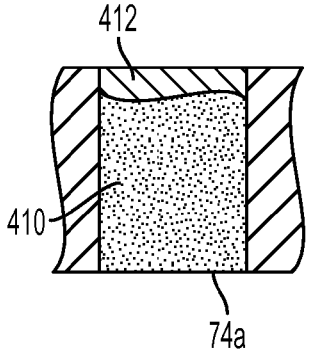
FIG. 17 is a sectional view of a representative frac gate port with sand and a silicone plug as a filling material.
Figure 18:
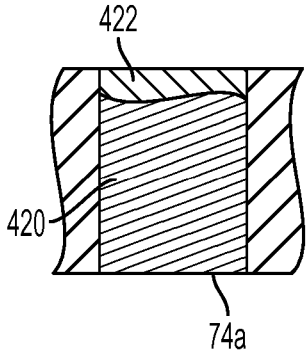
FIG. 18 is a sectional view of a representative frac gate port with calcium metal and a silicone plug as a filling material.
Figure 19:
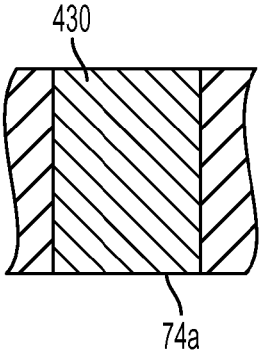
FIG. 19 is a sectional view of a representative frac gate port with an aluminum plug as a filling material.
Figure 20:
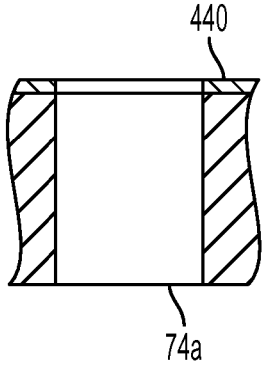
FIG. 20 is a sectional view of a representative frac gate port with a coating covering the port.

Turning now to FIGS. 16-20, wherein are shown a cross-sections of a representative port 74*a-z* (not to scale). In some exemplary embodiments of the present invention, the completion of the well will include substantially filling each of the plurality of frac gate ports 74*a-z* a filling material prior to attachment of the frac gate to the casing. During cementing, the filling material will prevent all, or most of the cement from entering the ports 74*a-z*. Once the casing is cemented, and the frac gate shifting sleeve is moved to the second position, the filling material will be removed by fluids flowing from within the frac gate. In some exemplary embodiments, and as shown in FIG. 16, the filling material is grease 400, which will be washed out by fluids from within the frac gate. In other exemplary embodiments, and as shown in FIG. 17, the filling material includes sand 410 with a silicone seal 412 to proximate the surface of the frac gate, which will be washed out by fluids from within the frac gate. In other exemplary embodiments, and as shown in FIG. 18, the filling material includes a calcium metal plug 420 with a silicone seal 422 to proximate the surface of the frac gate, which will be dissolved by water from within the frac gate. In other exemplary embodiments, as shown in FIG. 19, the filling material includes an aluminum plug 430. The aluminum plug is dissolved by acid spotted in the frac gate. In other exemplary embodiments, and as shown in relation to one port, in FIG. 20, the frac gate surface area, or at least the surface area about the ports 74*a-z*, is coated with a material 440 such as Teflon, viton, or nitrile, which is penetrated by fluids from within the frac gate after the shifting sleeve is moved to the second position.

In the foregoing description, exemplary embodiments of the methods of the present invention have been described using figures depicting a horizontal wellbore having one or more target completion intervals. Some exemplary embodiments of the methods and apparatus of the present invention additionally include non-horizontal wellbore completions, such as vertical and/or moderately deviated wellbores. In such exemplary embodiments, references herein to pulling the shifting tool into the vertical casing would indicate pulling the shifting tool to a point above the highest target completion interval.

It will be understood from the foregoing description that various modifications and changes may be made, and in fact will be made, in the exemplary embodiments of the present invention without departing from its true spirit. The descriptions in this specification are for purposes of illustration only and are not to be construed in a limiting sense.

We claim:

1. A method for use in a wellbore having a plurality of target completion intervals, comprising:

(a) running a casing, having a plurality of casing valves and at least one flapper valve formed therein, such that each of the plurality of casing valves is closed and proximate one of the target completion intervals, and each of the at least one flapper valves is open and positioned above one of the plurality of casing valves;

(b) cementing the casing within the wellbore;

(c) opening one of the plurality of casing valves with a shifting tool;

(d) breaking down the target completion interval proximate the opened casing valve;

(e) treating the target completion interval;

(f) closing the flapper valve immediately above the opened casing valve, using the shifting tool;

(g) repeating (c) through (f) for each of the remaining plurality of target completion intervals, excluding the last of such intervals; and (h) repeating (c) through (e) for the last of the plurality of target completion intervals;

wherein the order of opening the target completion intervals is from the lowest to the highest.

2. A method of completing a well, the well having a wellbore, the wellbore penetrating a plurality of target completion intervals, comprising:

(a) running a casing, having a plurality of casing valves and at least one flapper valve formed therein, such that each casing valve is proximate one of the target completion intervals and each flapper valve is positioned above one of the casing valves, each flapper valve being in an open position, each flapper valve having closing mechanism and a profile, the wellbore forming an annulus about at least part of the casing proximate the target completion intervals, each casing valve having a plurality of ports for fluid flow into the casing valve interior, each casing valve further having a shifting sleeve, the shifting sleeve having an end, the shifting sleeve blocking each of the plurality of ports until the shifting sleeve end is moved past each such blocked port, the shifting sleeve further having a profile;

(b) cementing the casing such that cement fills substantially all the wellbore annulus proximate the target completion intervals, the cement substantially blocking at least one of the plurality of ports on each of the casing valves;

(c) opening one of the casing valves by engaging the shifting sleeve profile with a shifting tool and moving the shifting tool, whereby the shifting tool moves the engaged shifting sleeve profile and the shifting sleeve, the movement moving the shifting sleeve end past the at least one of the plurality of ports that is substantially blocked by cement;

(d) breaking down the target completion interval by applying pressure through a casing fluid to fracture the cement substantially blocking the at least one port on the casing valve and the target completion interval, the fracture enabling fluid communication between the target completion interval and the casing valve interior;

(e) isolating the fractured target completion interval by engaging the flapper valve profile with the shifting tool and moving the profile, the profile movement causing the flapper valve closing mechanism to close the flapper valve, the flapper valve closed being the flapper valve positioned above the casing valve that is proximate the fractured target completion interval;

(f) repeating (c) through (e) for each of the remaining plurality of target completion intervals, excluding the last of such intervals; and (g) repeating (c) through (d) for the last of the plurality of target completion intervals.

3. The method of claim 2, further comprising: (d') treating each of the target completion intervals after breaking down the target completion interval.

4. The method of claim 2, further comprising: positioning the shifting tool to a position above the uppermost of all the plurality of casing valves and flapper valves prior to treating.

5. The method of claim 2, further comprising:

(h) optionally, isolating the subsequent target completion interval.

6. The method of claim 2, wherein the shifting tool has an engagement member and the shifting tool is hydraulically operable to alternately move the engagement member from a retracted position to an extended position, and further wherein, engaging the casing valve profile with a shifting tool comprises: running the shifting tool through the casing valve interior until the shifting tool engagement member is below the shifting sleeve profile; hydraulically moving the shifting tool engagement member from the retracted to the extended position; pulling the shifting tool until the extended engagement member engages the shifting sleeve profile and moves the shifting sleeve, and hydraulically moving the shifting tool engagement member from the extended to the retracted position;

and further wherein, engaging the flapper valve profile with a shifting tool comprises: hydraulically moving the shifting tool engagement member from the retracted to the extended position, pulling the shifting tool upward through the flapper valve until the extended engagement member engages the flapper valve profile and closes the flapper valve, and hydraulically moving the shifting tool engagement member from the extended position to the retracted position.

7. The method of claim 2, wherein isolating the fractured target completion interval comprises: if the flapper valve does not close, placing a sand plug within the casing and casing valve, proximate the fractured target completion interval, such that fluid flow into and out of the casing valve ports is substantially prevented.

8. A method of completing a well, the well having a wellbore, the wellbore penetrating a plurality of target completion intervals, comprising:

(a) running a casing, having a plurality of casing valves formed therein, such that each casing valve is proximate one of the target completion intervals, the wellbore forming an annulus about at least part of the casing proximate the target completion intervals, each casing valve having a longitudinal axis, an interior and a plurality of ports for fluid flow into the casing valve interior, the plurality of ports being spaced circumferentially about the valve, each casing valve further having a shifting sleeve, the shifting sleeve having an end, the shifting sleeve blocking each of the plurality of ports until the shifting sleeve end is moved past each such blocked port;

(b) cementing the casing such that cement fills substantially all the wellbore annulus proximate the target completion intervals, the cement substantially blocking at least one of the plurality of ports on each of the casing valves;

(c) opening one of the casing valves by moving the shifting sleeve end past the at least one of the plurality of ports that is substantially blocked by cement, the movement being substantially linear along the casing valve longitudinal axis;

(d) breaking down the proximate target completion interval by applying pressure through a casing fluid to fracture the cement substantially blocking the at least one port on the casing valve and the target completion interval, the fracture enabling fluid communication between the target completion interval and the casing valve interior;

(e) isolating the fractured target completion interval;

(f) repeating (c) through (e) for each of the remaining plurality of target completion intervals, excluding the last of such intervals; and (g) repeating (c) through (d) for the last of the plurality of target completion intervals.

9. The method of claim 8, wherein the well is completed by eliminating the isolation of the isolated target completion intervals, allowing fluids to enter the casing through the casing valves.

10. The method of claim 8, further comprising: (h) optionally, isolating the subsequent target completion interval.

11. The method of claim 8, further comprising: (d') treating each of the target completion intervals after breaking down the target completion interval.

12. The method of claim 8, wherein running a casing having a plurality of casing valves further comprises: running a casing having a plurality of flapper valves such that each flapper valve is positioned above one of the casing valves, each flapper valve being in an open position, thereby facilitating fluid communication therethrough, and further wherein isolating the fractured target completion interval further comprises:

closing the flapper valve that is positioned above the casing valve that is proximate the fractured target completion interval.

13. The method of claim 12, wherein the shifting sleeve in each of the plurality of casing valves has an interior and a profile positioned circumferentially about the shifting sleeve interior, and opening each of the plurality of casing valves comprises: engaging the profile with a shifting tool and moving the shifting tool, whereby the shifting tool moves the engaged shifting sleeve profile and the shifting sleeve.

14. The method of claim 13, further comprising: (d') positioning the shifting tool to a position above the uppermost of all the plurality of casing valves and flapper valves, and treating each of the target completion intervals after breaking down the target completion interval.

15. The method of claim 13, wherein the casing has an interior, the interior having a cross-sectional area, and the shifting sleeve interior has a minimum cross-sectional area at least as large as the casing interior's cross-sectional area, and further wherein the shifting sleeve profile is positioned completely outside the shifting sleeve interior minimum cross-sectional area.

16. The method of claim 15, wherein the flapper valve has an interior, the flapper valve interior having a minimum cross-sectional area at least as large as the casing interior's cross-sectional area, and further wherein the flapper valve profile is positioned completely outside the flapper valve interior minimum cross-sectional area.

17. The method of claim 8, wherein isolating the fractured target completion interval comprises: placing a sand plug within the casing and casing valve, proximate the fractured target completion interval, such that fluid flow into and out of the casing valve ports is substantially prevented.

18. The method of claim 8, wherein the well has a substantially horizontal wellbore portion, the horizontal wellbore portion has a lower side positioned beneath the casing valve, and the target completion interval is in the horizontal wellbore portion, and further wherein at least one of the casing valves lies on the wellbore lower side and at least one of the plurality of casing valve ports is proximate the wellbore lower side, such that the cement between such at least one port and the wellbore is substantially less than the cement between at least one other of the plurality of casing valve ports.

19. The method of claim 18, wherein the casing comprises two casing joints attached proximate each of the casing valves lying on the wellbore lower side, the casing valve elevating at least a portion of the two casing joints above the wellbore lower side.

20. A method of completing a well, the well having a wellbore, the wellbore penetrating a target completion interval, comprising:

running a casing, having a casing valve formed therein, such that the casing valve is proximate the target completion interval, the wellbore forming an annulus about at least part of the casing proximate the target completion interval, the casing valve having a longitudinal axis, an interior and a plurality of ports for fluid flow into the casing valve interior, the plurality of ports being spaced circumferentially about the casing valve, the casing valve having a shifting sleeve, the shifting sleeve having a distal end, the shifting sleeve blocking each of the plurality of ports until the shifting sleeve distal end is moved past each such blocked port;

cementing the casing such that cement fills substantially all the wellbore annulus proximate the target completion interval, the cement substantially blocking at least one of the plurality of ports;

opening the casing valve by moving the shifting sleeve end past the at least one of the plurality of ports that is substantially blocked by cement, the movement being substantially linear along the casing valve longitudinal axis; and breaking down the proximate target completion interval by applying pressure through a casing fluid to fracture the cement substantially blocking the at least one port on the casing valve and the target completion interval.

21. The method of claim 20, further comprising: treating the target completion intervals after breaking down the target completion interval.

22. The method of claim 20, further comprising: locking the shifting sleeve such that the casing valve is locked in an open position.

23. The method of claim 20, wherein the well has a substantially horizontal wellbore portion, the horizontal wellbore portion has a lower side positioned beneath the casing valve, and the target completion interval is in the horizontal wellbore portion, and further wherein the casing valve lies on the wellbore lower side and at least one of the plurality of casing valve ports is proximate the wellbore lower side, such that the cement between such at least one port and the wellbore is substantially less than the cement between at least one other of the plurality of casing valve ports.

24. The method of claim 23, wherein the casing comprises two casing joints attached proximate the casing valve lying on the wellbore lower side, the casing valve elevating at least a portion of the two casing joints above the wellbore lower side.

* * * * *